US006773362B1

(12) United States Patent
Choi

(10) Patent No.: US 6,773,362 B1
(45) Date of Patent: Aug. 10, 2004

(54) IMPACT ACCURACY INCREASING PUTTER

(76) Inventor: Youngil Choi, 305 E. Valencia Ave. #P, Burbank, CA (US) 91502

( * ) Notice: Subject to any disclaimer, the term of this patent is extended or adjusted under 35 U.S.C. 154(b) by 0 days.

(21) Appl. No.: 10/445,338

(22) Filed: May 27, 2003

(51) Int. Cl.[7] ..... A63B 53/08
(52) U.S. Cl. ..... 473/340
(58) Field of Search ..... 473/252, 294, 473/295, 257, 204, 316, 339, 404, 340

(56) References Cited

U.S. PATENT DOCUMENTS

| | | | | |
|---|---|---|---|---|
| 2,321,773 A | | 6/1943 | Ruemelin | 473/201 |
| 2,445,718 A | | 7/1948 | Sternberg et al. | 473/203 |
| 3,170,690 A | | 2/1965 | Goranson et al. | 473/295 |
| 4,252,317 A | * | 2/1981 | Vezina | 473/294 |
| 5,431,391 A | * | 7/1995 | Tracey | 473/257 |
| 5,672,117 A | | 9/1997 | Dar | 473/232 |
| 6,491,591 B1 | | 12/2002 | Schuster | 473/212 |

* cited by examiner

*Primary Examiner*—Kim Nguyen
(74) *Attorney, Agent, or Firm*—Eugene Oak

(57) ABSTRACT

A noble pendulum motion putter with an increased impact accuracy, by minimizing unnecessary side oscillation momentum that is vertical to the pendulum motion, is comprised of; 1) a straight cylindrical putter head having a void inside for receiving weights; 2) a level gauge embedded on the upper face of the putter head; 3) an elbow handle pivotally connected to a shaft at the top with a right angle creating a pendulum motion; and 4) a shaft connecting the putter head and the handle in a perpendicular position.

2 Claims, 5 Drawing Sheets

Fig.1 Priority Art

IMPACT ACCURACY INCREASING PUTTER

BACKGROUND OF THE INVENTION

Putting is known as the most difficult and frustrating part of a golf game. If the ball is not hit at right angle and with the proper strength, it may make the situation more badly. In spite of many golf putters designed to give a pendulum motion for hitting the ball, none of them indicates exact horizontal level for just impact at the moment of impact.

1. Field of the Invention

This invention relates to a golf putter designed especially for improving the accuracy of a putting game for an amateur or weekend golfer.

2. Description of Prior Art

Putters utilizing a pendulum motion are described in U.S. Pat. No. 2,321,773 to Ruemelin, U.S. Pat. No. 2,445,718 to Sternberg et al., U.S. Pat. No. 3,170,690 to Goranson et al., U.S. Pat. No. 4,252,317 to Veniza, U.S. Pat. No. 5,672,117 to Dar, and U.S. Pat. No. 6,491,591 to Schuster.

Among them, the closest art to the current invention is U.S. Pat. No. '4,252,317 to Veniza. His putter comprises four parts, namely a putter head 1, a lower shaft 3, an upper shaft 5, and a handle 7. The handle 7 endows pendulum mobility to the putter. The upper shaft 5 can be rotated 180 degrees in relation to the lower shaft 3, allowing for both left-handed and right-handed putting. This rotatable connection between the upper shaft 5 and lower shaft 3 may cause a slight rotation of the putter head 1 at the moment of impact if location of impact is not at the exact center of the putter head. Such a rotation would drive the golf ball from its originally intended direction and worsen a player's score.

Moreover, all of the prior art are only concerned with the pendulum motion on the invention. However, for most amateur golfers it is very difficult to hold the putter in an exact, upright position. FIG. 1 is a schematic drawing of putting position using a putter of prior art. There is an angle (1—1) between the shaft (1–2) and a vertical line (1–3) to the ground surface (1–4). FIG. 2 is an overview of the trajectory (1–5) of the putter head of prior art in pendulum motion. If a golfer releases or pushes the putter to hit the golf ball (1–6) in a declined position, the natural motion of the putter head to return its position energy to a lowest level will cause a momentum (1–7) horizontally vertical to the direction of the ideal pendulum trajectory (1–8). It is clear that the latitudally oscillating putter head will create an unexpected spin on the golf ball at the moment of an impact, resulting in unpredictable motion.

None of the prior art discloses a function to increase the accuracy of putting impact as described in this invention.

SUMMARY OF THE INVENTION

It is an object of the present invention to provide a golf putter having increased accuracy of impact. The putter is comprised of; 1) a head in the shape of cylinder attached to a shaft, whereby the longitudinal axis of the head lying on a pendulum trajectory of the head; 2) a water level gauge visibly embedded in the upper surface of the putter head; 3) a shaft; 4) and a handle in the shape of a right angle pivotally attached to the upper end of the shaft. The putter of the present invention aids to create a non-side oscillating pendulum motion. The level gauge on the putter head helps a golfer adjust to an upright shaft position. The pendulum motion combined with the upright shaft position angle results in optimal impact to a golf ball. The putter of the present invention may be used either by a left-handed or a right-handed player without adjusting the putter head.

BRIEF DESCRIPTION OF THE DRAWINGS

FIG. 5-1 is a top view of the putter head of this invention.

FIG. 5-2 is a front view of the putter head of this invention.

DETAILED DESCRIPTION OF PREFERRED EMBODIMENTS

Figure 3:
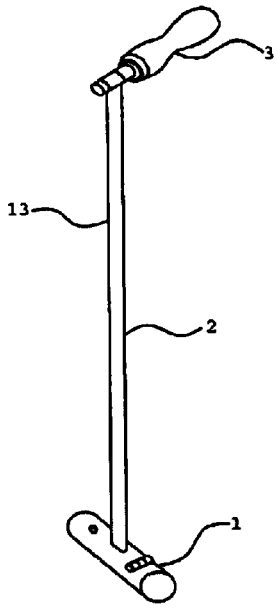
FIG. 3 is a perspective view of the putter of this invention.
Figure 4:
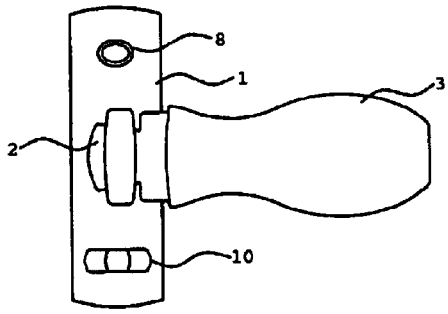
FIG. 4 is a top view of the putter of this invention.

As described above, it is the purpose of the present invention to provide a non-oscillating pendulum motion putter. The putter has been designed specifically for this purpose, as shown in FIGS. 3 and 4, a perspective view of the putter and an top view of the putter, respectively.

1. The putter head (1) is soldered to the shaft (2) taking a perpendicular position to the handle (3), which is pivotally engaged on the top of the shaft (2), so the longitudinal axis of the putter head (1) lies on the trajectory of the movement of the putter head (1). This orientation of the head (1) minimizes air friction, which causes minute vibrations of the putter head and decreases the accuracy of impact due to the broad frontal surface of conventional putter heads.

2. A level gauge (10) embedded on the upper surface (9) of the putter head (1) helps a golfer keep the putter (13) in an upright position, thereby eliminating the unnecessary lateral movement of the putter head (1) described in the FIG. 2.

Figure 5:
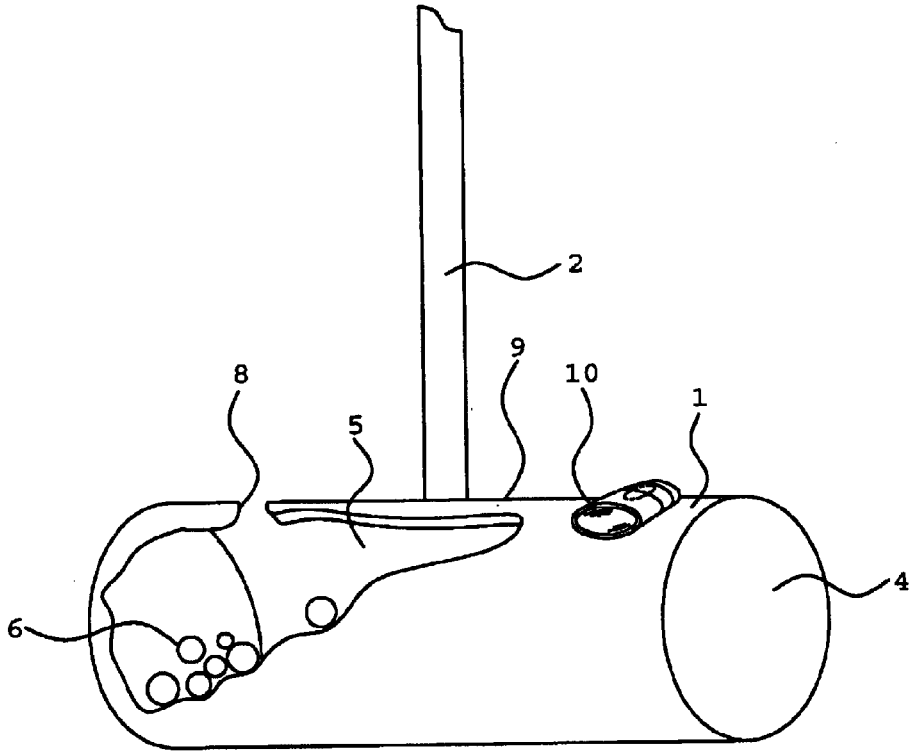
FIG. 5 is a schematic drawing of the putter head of this invention.
Figures 1, 5:
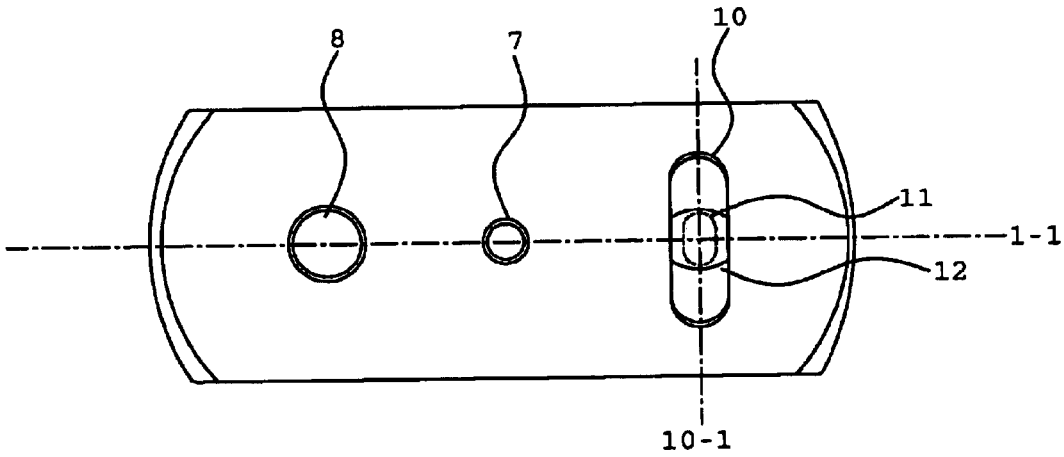
Figures 2, 5:
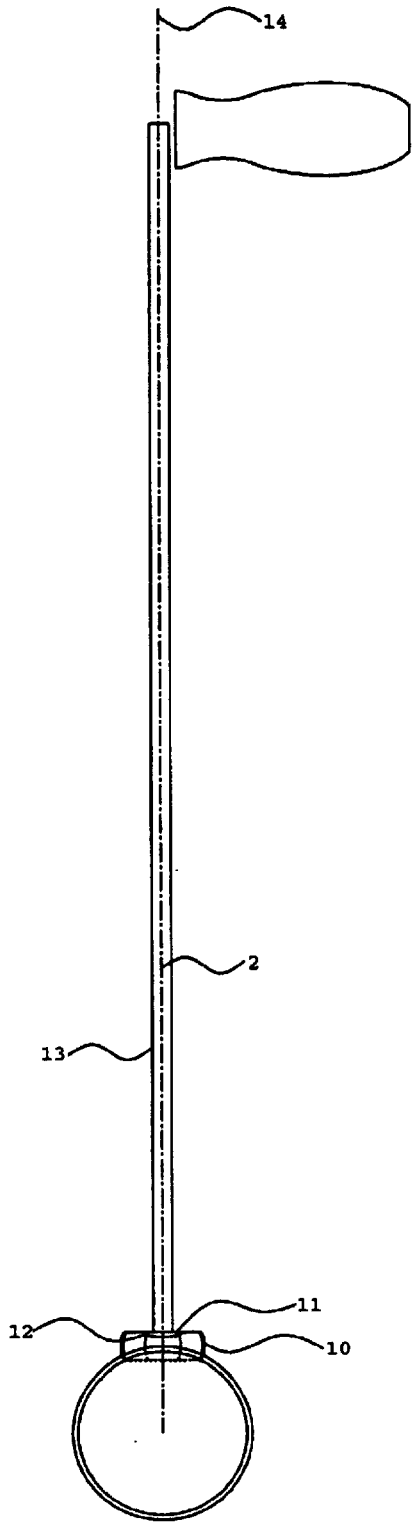

FIG. 5 is a schematic, partially transparent view of the putter head (1) of this invention. The putter head (1) is in the shape of a hollow cylindrical pipe. The space (5) within the putter head (1) can be filled with weights (6), allowing a golfer to adjust the weight of the putter head (1). Both end faces (4) of the putter head (1) are flat.

Figure 1:
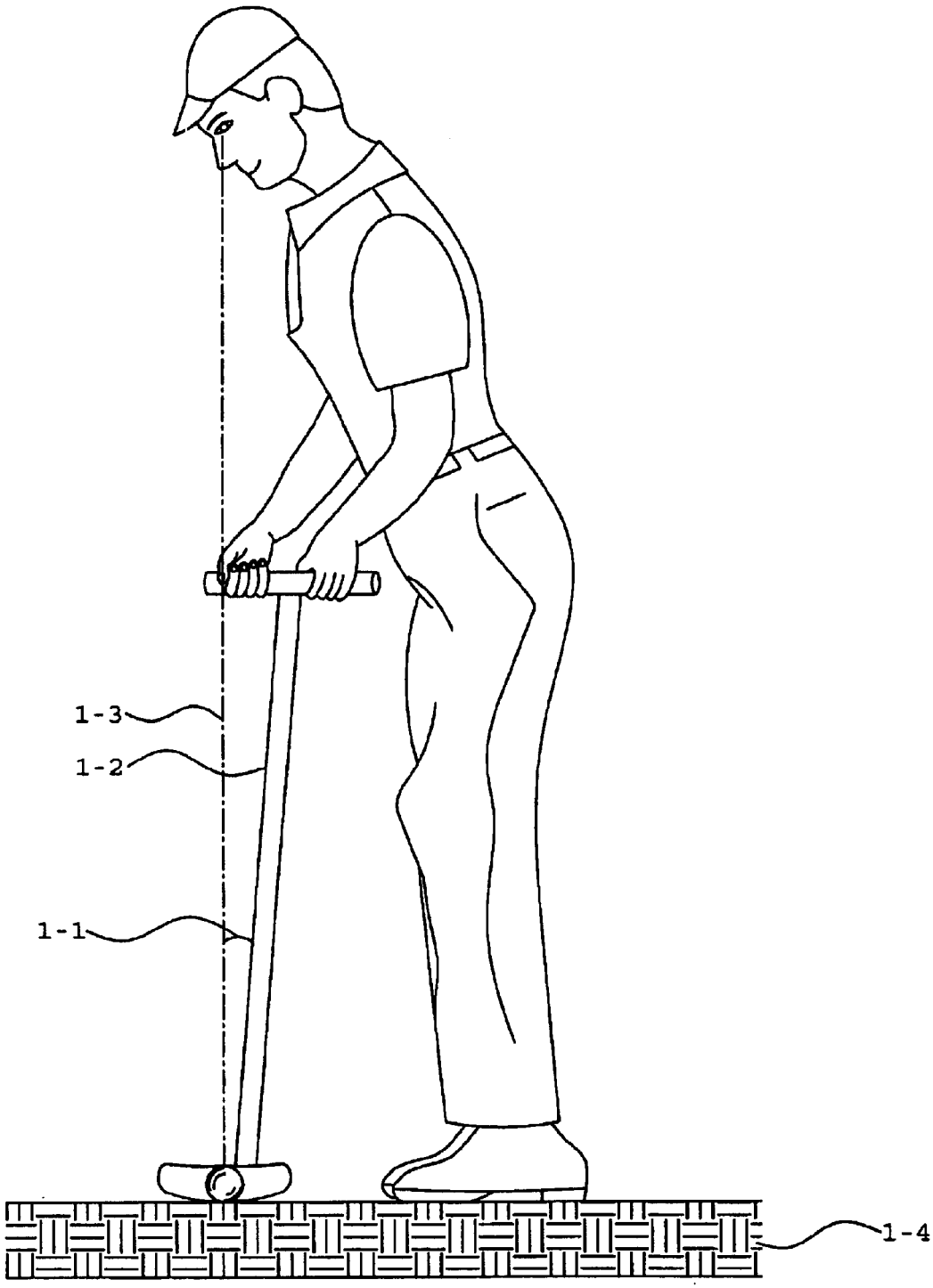
FIG. 1 is a schematic drawing of putter positions of prior art.
Figure 2:
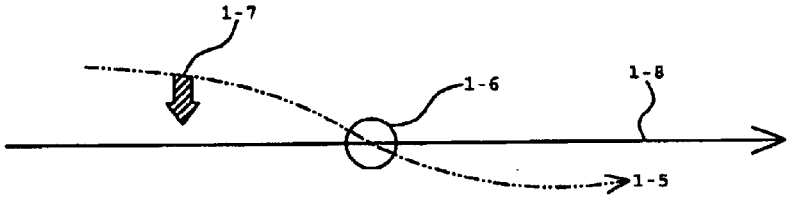
Fig.2 Prior Art
FIG. 2 is an overview of the trajectory of the pendulum motion of prior art.

FIG. 5-1 is a top view of the putter head of this invention. The putter head (1) is welded to a shaft (2) at its center (7). A hole (8) for receiving weights (6) is provided on one side of the upper surface (9) of the putter head (1). A level gauge (10) is visibly embedded in the other side of the upper surface (9) of the putter head (1). The long axis (10-1) of the level gauge (10) locates parallel to that of the putter head (1) and that of the putter head (1—1) makes a right angle. The bubble (11) and line markings (12) of the level gauge (10) allow a golfer to hold the putter (13) so that the shaft (2) is aligned with the perpendicular line (14) to the ground, as shown in FIG. 5-2.

Figure 6:
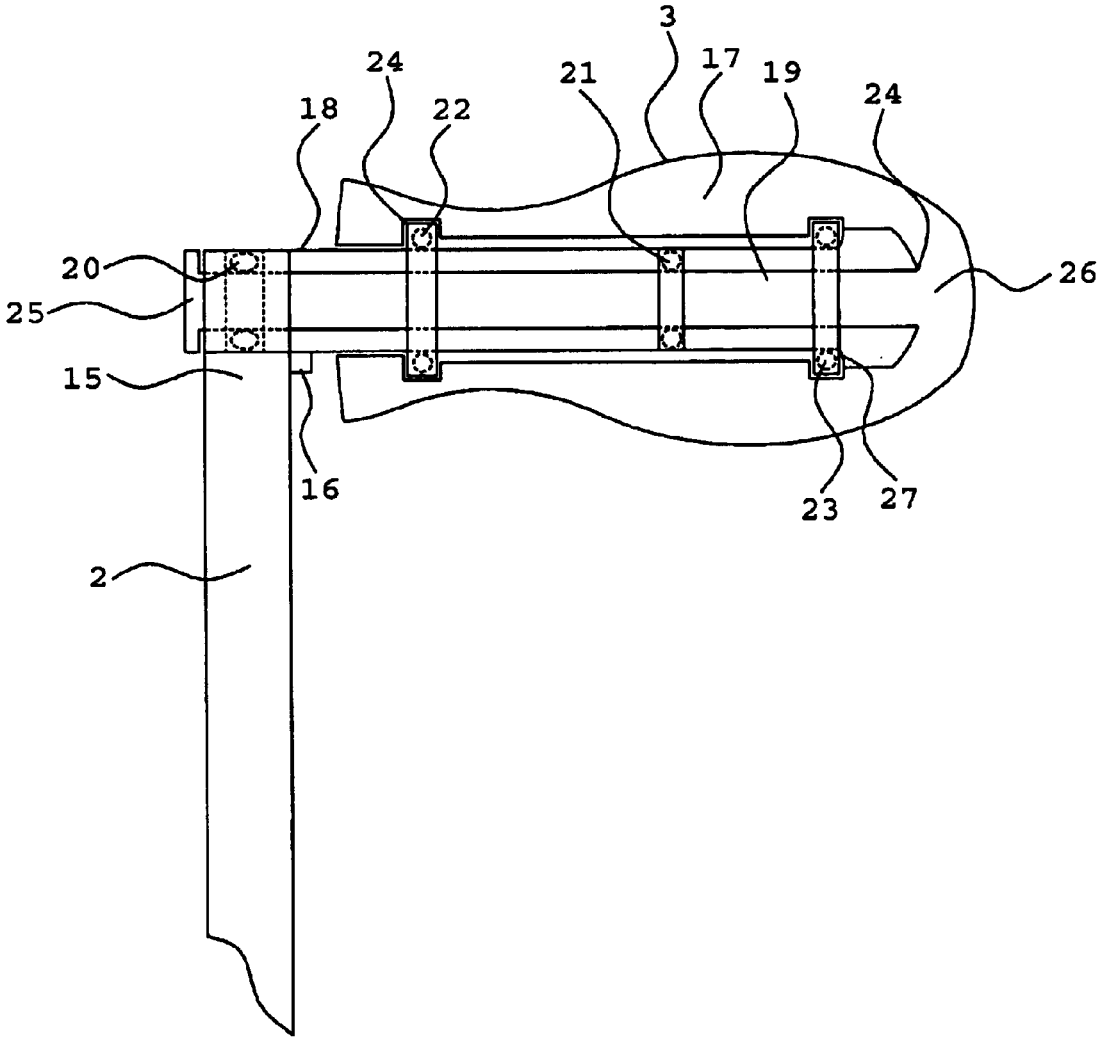
FIG. 6 is a cross-sectional view of the handle of this invention.

Referring to FIG. 6, the handle (3) is designed to minimize any unnecessary oscillation, other than the pendulum motion, that may result from improper positioning of bearings within the handle (3). The handle (3) is pivotally attached to the upper end (15) of the shaft (2) at a right angle (16) to the shaft (2). The handle (3) is comprised of a handle cover (17) (made of materials including but not limited to wood, iron, or iron covered with leather), two metal pipes (18 and 19) of different diameter, and four small ball bearings (20, 21, 22, and 23). Two bearings (20) and (21) are of a same size, inner diameter is equivalent to the outer diameter of the inner pipe (19) and outer diameter is equivalent to the inner diameter the outer pipe (18) and the other two bearings (22) and (23) are of a same size, larger than the two bearings of (20) and (21). One end (24) of the inner pipe (19) is solidly anchored inside of the handle cover (17). The other end of the inner pipe (19) is blocked with a socket (25) having a head larger than the outer pipe (18) in diameter. (A metal rod having the same diameter as the inner pipe (19) can be used in place of the inner pipe.) Two small bearings (20 and 21) are placed between the inner pipe (19) and outer pipe (18). One small bearing (20) is located on the top (15) of the shaft to render a pendulum motion to the shaft (2). The other small bearing (21) is located in the handle close to the dead end (26). The other two larger bearings are placed between the outer pipe (18) and the handle cover (17). One larger bearing (22) is located in the handle cover (17) close to the shaft (2). The other larger bearing (23) is located deep inside of the handle cover (17). One end of the outer pipe (18) is separated from the top end (15) of the shaft (2) as shown in FIG. 6. The other end (27) of the outer pipe (18) has a larger diameter so that it can be anchored behind the larger bearing (23). The larger bearings (22 and 23) are positioned in grooves (24). The four positioned bearings (20, 21, 22, and 23) hold the inner (19) and outer (20) pipes tightly and prevent undesired movement of the shaft (2) connected to the pipes (18 and 19).

In Vezina's invention, the arm (25) and the shaft (3.5) are connected as one body and roll at the same time. The extremely different weight between the front and the rear of the front bearing (31) causes a vertical rotational momentum around it. As known well, every ball bearing has compressible clearance, which is filled with lubricant to reduce frictions between the balls and cage of the bearing. This let the position of the arm (25) to be slightly declined toward to the shaft (3,5). In other words, the position of the arm (25) inside of the handle proper (23) is uncontrollable. But, no means to check the relative position of the putter to the around is disclosed in Vezina's invention. Meanwhile, in the current application, the inner pipe (19), which is equivalent to the arm (25) of the Vezina's invention, is anchored to the inside of the handle cover (17) and does not rotate with the shaft (2) due to the small bearings (20,21). The larger outer pipe (18) is separated from the shaft (2) and guides the shaft (2) to be aligned to a right angel (16) to the handle (3). The weight balance around the small bearing (20) is equal because the shaft (2) is separated from the handle (3). Therefore, the vertical momentum of rotation around the small bearing (20) is zero. However, there is a levering point when a player holds the handle (3). In this case the levering point is on one of the second finger of the player. The player can control the alignment of the putter by observing the bubble (11) and markings (12) in the level gauge (10) on the putter head (1). Or, if the handle (3) and the inner pipe (19) is aligned horizontal to the geological surface, the shaft (2) rotates freely.

The best mode of the invention is to solder the putter head to the shaft forming a right angle with the handle, embed a level gauge on the upper surface of the putter head, and provide a handle that minimizes unnecessary oscillation by installing four bearings in the handle.

What is claimed is:

1. A golf putter comprising:

1) A straight cylindrical putter head, in a shape of straight cylinder pipe blocked at both ends having a void inside, soldered to a shaft with the longitudinal axis of the head lies on the pendulum trajectory line of the putter head;

2) a level gauge embedded on the upper face of the putter head, making a right angle with the longitudinal axis of the level gauge and that of the putter head; 3) an elbow handle, which is comprised of a handle cover, two metal pipes of different diameter, and four ball bearings, pivotally attached to the shaft at the top end with a right angle to the shaft enabling a pendulum motion for a shaft; and 4) the shaft connecting the putter head and the handle in a perpendicular position.

2. The golf putter of claim 1, wherein the elbow handle is comprised of; 1) a handle cover in which one inner pipe, one outer pipe, two bearings of same size and another two bearings of the same size are installed; 2) an inner pipe, one end of which is solidly anchored inside of the handle cover and the other end is blocked with a socket; 3) an outer pipe that is separated from the shaft but guide the shaft to be aligned to a right angle to the handle; 4) two small bearings, one of which is located in the upper head of the shaft and the other is located between the inner pipe and outer pipe; and 5) two larger bearings that are located in the handle cover between the outer pipe and handle cover.

* * * * *